US008712318B2

(12) United States Patent
Norin

(10) Patent No.: US 8,712,318 B2
(45) Date of Patent: Apr. 29, 2014

(54) INTEGRATED MULTI-SAT LNB AND FREQUENCY TRANSLATION MODULE

(75) Inventor: John L. Norin, Redondo Beach, CA (US)

(73) Assignee: The DIRECTV Group, Inc., El Segundo, CA (US)

( * ) Notice: Subject to any disclaimer, the term of this patent is extended or adjusted under 35 U.S.C. 154(b) by 1063 days.

(21) Appl. No.: 12/127,718

(22) Filed: May 27, 2008

(65) Prior Publication Data

US 2008/0298516 A1 Dec. 4, 2008

Related U.S. Application Data

(60) Provisional application No. 60/932,060, filed on May 29, 2007, provisional application No. 60/932,061, filed on May 29, 2007.

(51) Int. Cl.
*H04H 20/74* (2008.01)

(52) U.S. Cl.
USPC ..... 455/3.02

(58) Field of Classification Search
None
See application file for complete search history.

(56) References Cited

U.S. PATENT DOCUMENTS

| | | | |
|---|---|---|---|
| 3,581,209 | A | 5/1971 | Zimmerman |
| 3,670,275 | A | 6/1972 | Kalliomaki et al. |
| 4,064,460 | A | 12/1977 | Gargini |
| 4,132,952 | A | 1/1979 | Hongu et al. |
| 4,354,167 | A | 10/1982 | Terreault et al. |
| 4,382,266 | A | 5/1983 | Panzer |
| 4,397,037 | A | 8/1983 | Theriault |
| 4,403,343 | A | 9/1983 | Hamada |
| 4,509,198 | A | 4/1985 | Nagatomi |
| 4,513,315 | A | 4/1985 | Dekker et al. |

(Continued)

FOREIGN PATENT DOCUMENTS

| | | |
|---|---|---|
| CN | 1413021 | 4/2003 |
| DE | 10114082 A1 | 1/2003 |

(Continued)

OTHER PUBLICATIONS

International Search Report and Written Opinion dated Dec. 18, 2008 in International Application No. PCT/US2008/006750 filed May 28, 2008 by John L. Norin.

(Continued)

*Primary Examiner* — Philip Sobutka

(57) ABSTRACT

Systems and devices for receiving satellite signals are disclosed. A system in accordance with the present invention comprises a plurality of amplifiers, each amplifier in the plurality of amplifiers receiving the signals, a Frequency Translation Module, comprising a plurality of analog-to-digital converters, wherein each amplifier in the plurality of amplifiers is coupled to a separate analog-to-digital converter in the plurality of analog-to-digital converters, wherein the plurality of analog-to-digital converters convert the signals into digital data streams, a digital signal processing section, coupled to the plurality of analog-to-digital converters, wherein the digital signal processing section at least translates the frequency of the digital data streams and filters the digital data streams, a digital-to-analog section, coupled to the digital signal processing section; wherein the digital-to-analog section downconverts the satellite signals to an intermediate frequency band, and a receiver, coupled to the digital-to-analog section, wherein the receiver receives an output of the digital-to-analog section of the module at the intermediate frequency band, the output of the digital to analog section being on a single coaxial cable.

15 Claims, 7 Drawing Sheets

(56) References Cited

U.S. PATENT DOCUMENTS 4,530,008 A 7/1985 McVoy
4,532,543 A 7/1985 Groenewegen
4,538,175 A 8/1985 Balbes et al.
4,545,075 A 10/1985 Miller et al.
4,556,988 A 12/1985 Yoshisato
4,592,093 A 5/1986 Ouchi et al.
4,608,710 A 8/1986 Sugiura
4,628,506 A 12/1986 Sperlich
4,656,486 A 4/1987 Turner
4,663,513 A 5/1987 Webber
4,667,243 A 5/1987 Blatter et al.
4,672,687 A 6/1987 Horton et al.
4,675,732 A 6/1987 Oleson
4,710,972 A 12/1987 Hayashi et al.
4,723,320 A 2/1988 Horton
4,761,825 A 8/1988 Ma
4,761,827 A 8/1988 Horton et al.
4,785,306 A 11/1988 Adams
4,802,239 A 1/1989 Ooto
4,805,014 A 2/1989 Sahara et al.
4,813,036 A 3/1989 Whitehead
4,823,135 A 4/1989 Hirashima et al.
4,860,021 A 8/1989 Kurosawa et al.
4,866,787 A 9/1989 Olesen
4,876,736 A 10/1989 Kiewit
4,885,803 A 12/1989 Hermann et al.
4,903,031 A 2/1990 Yamada
4,945,410 A 7/1990 Walling
5,010,400 A 4/1991 Oto
5,027,430 A 6/1991 Yamauchi et al.
5,068,918 A 11/1991 Verheijen et al.
5,073,930 A 12/1991 Green et al.
5,119,509 A 6/1992 Kang
5,235,619 A 8/1993 Beyers, II et al.
5,249,043 A 9/1993 Grandmougin
5,276,904 A 1/1994 Mutzig
5,289,272 A 2/1994 Rabowsky et al.
5,301,352 A 4/1994 Nakagawa et al.
5,382,971 A 1/1995 Chanteau
5,437,051 A 7/1995 Oto
5,521,631 A 5/1996 Budow et al.
5,565,805 A 10/1996 Nakagawa et al.
5,572,517 A 11/1996 Safadi
5,574,964 A 11/1996 Hamlin
5,587,734 A 12/1996 Lauder et al.
5,617,107 A 4/1997 Fleming
5,649,318 A 7/1997 Lusignan
5,675,390 A 10/1997 Schindler et al.
5,708,961 A 1/1998 Hylton et al.
5,734,356 A 3/1998 Chang
5,748,732 A 5/1998 Le Berre et al.
5,760,819 A 6/1998 Sklar et al.
5,760,822 A 6/1998 Coutinho
5,787,335 A 7/1998 Novak
5,790,202 A 8/1998 Kummer et al.
5,793,413 A 8/1998 Hylton et al.
5,805,806 A 9/1998 McArthur
5,805,975 A 9/1998 Green et al.
5,835,128 A 11/1998 MacDonald et al.
5,838,740 A 11/1998 Kallman et al.
5,848,239 A 12/1998 Ando
5,864,747 A 1/1999 Clark et al.
5,883,677 A 3/1999 Hofmann
5,886,995 A 3/1999 Arsenault et al.
5,898,455 A 4/1999 Barakat et al.
5,905,941 A 5/1999 Chanteau
5,905,942 A 5/1999 Stoel et al.
5,923,288 A 7/1999 Pedlow, Jr.
5,936,660 A 8/1999 Gurantz
5,959,592 A 9/1999 Petruzzelli
5,970,386 A 10/1999 Williams
5,982,333 A 11/1999 Stillinger et al.
6,005,861 A 12/1999 Humpleman
6,011,597 A 1/2000 Kubo
6,023,603 A 2/2000 Matsubara
6,038,425 A 3/2000 Jeffrey
6,100,883 A 8/2000 Hoarty
6,104,908 A 8/2000 Schaffner et al.
6,134,419 A 10/2000 Williams
6,147,714 A 11/2000 Terasawa et al.
6,173,164 B1 1/2001 Shah
6,188,372 B1 2/2001 Jackson et al.
6,192,399 B1 2/2001 Goodman
6,198,449 B1 3/2001 Muhlhauser et al.
6,198,479 B1 3/2001 Humpleman et al.
6,202,211 B1 3/2001 Williams, Jr.
6,263,503 B1 7/2001 Margulis
6,292,567 B1 9/2001 Marland
6,304,618 B1 10/2001 Hafeez et al.
6,340,956 B1 1/2002 Bowen et al.
6,397,038 B1 5/2002 Green, Sr. et al.
6,424,817 B1 7/2002 Hadden
6,430,233 B1 8/2002 Dillon et al.
6,430,742 B1 8/2002 Chanteau
6,441,793 B1 8/2002 Shea
6,441,797 B1 8/2002 Shah
6,442,148 B1 8/2002 Adams et al.
6,452,991 B1 9/2002 Zak
6,463,266 B1 10/2002 Shohara
6,493,873 B1 12/2002 Williams
6,493,874 B2 12/2002 Humpleman
6,501,770 B2 12/2002 Arsenault et al.
6,510,152 B1 1/2003 Gerszberg et al.
6,549,582 B1 4/2003 Friedman
6,574,235 B1 6/2003 Arslan et al.
6,598,231 B1 7/2003 Basawapatna et al.
6,600,897 B1 7/2003 Watanabe et al.
6,622,307 B1 9/2003 Ho
6,653,981 B2 11/2003 Wang et al.
6,678,737 B1 1/2004 Bucher
6,728,513 B1 4/2004 Nishina
6,762,727 B2 7/2004 Rochford et al.
6,864,855 B1 3/2005 Fujita
6,865,193 B2 3/2005 Terk
6,879,301 B2 4/2005 Kozlovski
6,889,385 B1 5/2005 Rakib et al.
6,906,673 B1 6/2005 Matz et al.
6,941,576 B2 9/2005 Amit
6,944,878 B1 9/2005 Wetzel et al.
7,010,265 B2 3/2006 Coffin, III
7,016,643 B1 3/2006 Kuether et al.
7,020,081 B1 3/2006 Tani et al.
7,039,169 B2 5/2006 Jones
7,069,574 B1 6/2006 Adams et al.
7,085,529 B1 8/2006 Arsenault et al.
7,130,576 B1 * 10/2006 Gurantz et al. ..... 455/3.02
7,239,285 B2 7/2007 Cook
7,240,357 B1 7/2007 Arsenault et al.
7,245,671 B1 7/2007 Chen et al.
7,257,638 B2 8/2007 Celik et al.
7,260,069 B2 8/2007 Ram et al.
7,263,469 B2 8/2007 Bajgrowicz et al.
7,369,750 B2 5/2008 Cheng et al.
7,519,680 B1 4/2009 O'Neil
7,522,875 B1 4/2009 Gurantz et al.
7,542,715 B1 6/2009 Gurantz et al.
7,546,619 B2 6/2009 Anderson et al.
7,603,022 B2 10/2009 Putterman et al.
7,954,128 B2 5/2011 Maynard et al.
8,001,574 B2 8/2011 Hicks et al.
2001/0055319 A1 12/2001 Quigley et al.
2002/0044614 A1 4/2002 Molnar
2002/0140617 A1 10/2002 Luly et al.
2002/0152467 A1 10/2002 Fiallos
2002/0154055 A1 10/2002 Davis et al.
2002/0154620 A1 10/2002 Azenkot et al.
2002/0163911 A1 11/2002 Wee et al.
2002/0178454 A1 11/2002 Antoine et al.
2002/0181604 A1 12/2002 Chen
2003/0023978 A1 1/2003 Bajgrowicz
2003/0097563 A1 5/2003 Moroney et al.
2003/0129960 A1 7/2003 Kato
2003/0185174 A1 10/2003 Currivan
2003/0217362 A1 11/2003 Summers et al.

(56) References Cited

U.S. PATENT DOCUMENTS

| | | | | |
|---|---|---|---|---|
| 2003/0220072 | A1 | 11/2003 | Coffin, III | |
| 2004/0060065 | A1 | 3/2004 | James et al. | |
| 2004/0064689 | A1 | 4/2004 | Carr | |
| 2004/0107436 | A1 | 6/2004 | Ishizaki | |
| 2004/0123329 | A1 | 6/2004 | Williams et al. | |
| 2004/0136455 | A1 | 7/2004 | Akhter et al. | |
| 2004/0153942 | A1 | 8/2004 | Shtutman et al. | |
| 2004/0161031 | A1 | 8/2004 | Kwentus et al. | |
| 2004/0163125 | A1 | 8/2004 | Phillips et al. | |
| 2004/0184521 | A1 | 9/2004 | Chen et al. | |
| 2004/0192190 | A1 | 9/2004 | Motoyama | |
| 2004/0198237 | A1 | 10/2004 | Abutaleb et al. | |
| 2004/0203425 | A1 | 10/2004 | Coffin | |
| 2004/0214537 | A1* | 10/2004 | Bargroff et al. | 455/136 |
| 2004/0229583 | A1 | 11/2004 | Ogino | |
| 2004/0244044 | A1 | 12/2004 | Brommer | |
| 2004/0244059 | A1 | 12/2004 | Coman | |
| 2004/0255229 | A1 | 12/2004 | Shen et al. | |
| 2004/0261110 | A1 | 12/2004 | Kolbeck et al. | |
| 2005/0002640 | A1 | 1/2005 | Putterman et al. | |
| 2005/0033846 | A1 | 2/2005 | Sankaranarayan et al. | |
| 2005/0052335 | A1 | 3/2005 | Chen | |
| 2005/0054315 | A1 | 3/2005 | Bajgrowicz et al. | |
| 2005/0057428 | A1 | 3/2005 | Fujita | |
| 2005/0060525 | A1 | 3/2005 | Schwartz, Jr. et al. | |
| 2005/0066367 | A1 | 3/2005 | Fyke et al. | |
| 2005/0071877 | A1 | 3/2005 | Navarro | |
| 2005/0071882 | A1 | 3/2005 | Rodriguez et al. | |
| 2005/0089168 | A1 | 4/2005 | Kahre | |
| 2005/0118984 | A1 | 6/2005 | Akiyama | |
| 2005/0130590 | A1* | 6/2005 | Pande et al. | 455/12.1 |
| 2005/0138663 | A1 | 6/2005 | Throckmorton et al. | |
| 2005/0184923 | A1 | 8/2005 | Saito et al. | |
| 2005/0190777 | A1 | 9/2005 | Hess et al. | |
| 2005/0193419 | A1 | 9/2005 | Lindstrom et al. | |
| 2005/0198673 | A1 | 9/2005 | Kit et al. | |
| 2005/0204388 | A1 | 9/2005 | Knudson et al. | |
| 2005/0240969 | A1 | 10/2005 | Sasaki et al. | |
| 2005/0264395 | A1 | 12/2005 | Bassi | |
| 2005/0289605 | A1 | 12/2005 | Jeon | |
| 2006/0018345 | A1 | 1/2006 | Nadarajah et al. | |
| 2006/0030259 | A1 | 2/2006 | Hetzel et al. | |
| 2006/0041912 | A1 | 2/2006 | Kuhns | |
| 2006/0048202 | A1 | 3/2006 | Bontempi et al. | |
| 2006/0080707 | A1 | 4/2006 | Laksono | |
| 2006/0112407 | A1 | 5/2006 | Kakiuchi | |
| 2006/0133612 | A1 | 6/2006 | Abedi et al. | |
| 2006/0174282 | A1 | 8/2006 | Dennison et al. | |
| 2006/0225104 | A1 | 10/2006 | James et al. | |
| 2006/0259929 | A1 | 11/2006 | James et al. | |
| 2006/0294512 | A1 | 12/2006 | Seiden | |
| 2007/0083898 | A1 | 4/2007 | Norin et al. | |
| 2007/0202800 | A1 | 8/2007 | Roberts et al. | |
| 2008/0009251 | A1 | 1/2008 | Wahl et al. | |
| 2008/0064355 | A1 | 3/2008 | Sutskover et al. | |
| 2008/0127277 | A1 | 5/2008 | Kuschak | |
| 2008/0134279 | A1 | 6/2008 | Curtis et al. | |
| 2008/0205514 | A1 | 8/2008 | Nishio et al. | |
| 2009/0013358 | A1 | 1/2009 | Throckmorton et al. | |
| 2009/0150937 | A1 | 6/2009 | Ellis et al. | |
| 2009/0222875 | A1 | 9/2009 | Cheng et al. | |
| 2009/0252316 | A1 | 10/2009 | Ratmanski et al. | |

FOREIGN PATENT DOCUMENTS

| | | | |
|---|---|---|---|
| EP | 1447987 | A1 | 8/2004 |
| GB | 2354650 | | 3/2001 |
| GB | 2377111 | | 12/2002 |
| JP | 11355076 | A | 12/1999 |
| WO | 02082351 | A1 | 10/2002 |

OTHER PUBLICATIONS

EPO Communication dated May 31, 2011 in European Patent Application No. 06802486.8 filed Aug. 30, 2006 by Thomas H. James et al.
Non-final Office action dated Oct. 12, 2011 in U.S. Appl. No. 11/219,407, filed Sep. 2, 2005 by Thomas H. James et al.
Notice of Allowance dated Feb. 2, 2011 in U.S. Appl. No. 11/097,480, filed Apr. 1, 2005 by Thomas H. James et al.
Non-final Office action dated Feb. 18, 2011 in U.S. Appl. No. 12/195,256, filed Aug. 20, 2008 by Robert F. Popoli.
Notice of Allowance dated Jan. 10, 2011 in U.S. Appl. No. 11/097,479, filed Apr. 1, 2005 by Thomas H. James et al.
Notice of Allowance dated Feb. 17, 2011 in U.S. Appl. No. 11/097,615, filed Apr. 1, 2005 by Thomas H. James et al.
Chinese Office action dated Nov. 18, 2010 in Chinese Patent Application No. 200880017830.8 filed May 28, 2008 by John L. Norin.
EPO Supplementary search report dated Aug. 19, 2010 in European Patent Application No. 06740394.9 filed Apr. 3, 2006 by Thomas H. James et al.
EPO Supplementary search report dated Aug. 16, 2010 in European Patent Application No. 06749160.5 filed Apr. 3, 2006 by Thomas H. James et al.
EPO Supplementary search report dated Aug. 19, 2010 in European Patent Application No. 06749155.5 filed Apr. 3, 2006 by Thomas H. James et al.
Non-final Office action dated Jul. 20, 2010 in U.S. Appl. No. 11/810,774, filed Jun. 7, 2007 by Hanno Basse et al.
Non-final Office action dated Jun. 21, 2010 in U.S. Appl. No. 11/219,418, filed Sep. 2, 2005 by Thomas H. James et al.
Non-final Office action dated Jul. 20, 2010 in U.S. Appl. No. 10/255,344, filed Sep. 25, 2002 by Thomas H. James et al.
Non-final Office action dated Jul. 20, 2010 in U.S. Appl. No. 11/097,482, filed Apr. 1, 2005 by Thomas H. James et al.
Final Rejection dated Jul. 21, 2010 in U.S. Appl. No. 11/219,407, filed Sep. 2, 2005 by Thomas H. James et al.
Mexican Office action dated Jul. 26, 2010 in Mexican Patent Application No. MX/a/2008/015659 filed Jun. 18, 2007 by Hanno Basse et al.
Non-final Office action dated Aug. 13, 2010 in U.S. Appl. No. 11/820,205, filed Jun. 18, 2007 by Hanno Basse et al.
Non-final Office action dated Jun. 23, 2010 in U.S. Appl. No. 11/820,446, filed Jun. 19, 2007 by Thomas H. James et al.
Chinese Office action dated Jun. 23, 2010 in Chinese Patent Application No. 200780029062.3 filed Jun. 7, 2007 by Hanno Basse et al.
Supplementary European search report dated Jul. 6, 2010 in European Patent Application No. 06749159.7 filed Apr. 3, 2006 by Thomas H. James et al.
EPO Communication dated Jun. 25, 2010 in European Patent Application No. 07815055.4 filed Jun. 7, 2007 by Hanno Basse et al.
Non-final Office action dated Aug. 4, 2010 in U.S. Appl. No. 11/097,480, filed Apr. 1, 2005 by Thomas H. James et al.
Final Rejection dated Jul. 7, 2010 in U.S. Appl. No. 11/097,479, filed Apr. 1, 2005 by Thomas H. James et al.
Final Rejection dated Jun. 21, 2010 in U.S. Appl. No. 11/219,247, filed Sep. 2, 2005 by Thomas H. James et al.
Notice of Allowance dated Aug. 16, 2010 in U.S. Appl. No. 11/097,723, filed Apr. 1, 2005 by Thomas H. James et al.
Final Rejection dated Mar. 29, 2010 in U.S. Appl. No. 11/097,480, filed Apr. 1, 2005 by Thomas H. James et al.
Final Rejection dated Mar. 29, 2010 in U.S. Appl. No. 11/097,615, filed Apr. 1, 2005 by Thomas H. James et al.
Final Rejection dated Apr. 8, 2010 in U.S. Appl. No. 11/810,774, filed Jun. 7, 2007 by Hanno Basse et al.
Final Rejection dated Apr. 1, 2010 in U.S. Appl. No. 11/097,625, filed Apr. 1, 2005 by Thomas H. James et al.
International Search Report and Written Opinion dated Apr. 23, 2010 in International Application No. PCT/US2010/020246 filed Jun. 1, 2010 by Robert F. Popoli.
Final Rejection dated Apr. 26, 2010 in U.S. Appl. No. 11/820,205, filed Jun. 18, 2007 by Hanno Basse et al.
Non-final Office action dated Aug. 31, 2010 in U.S. Appl. No. 11/097,615, filed Apr. 1, 2005 by Thomas H. James et al.
EPO Communication dated Aug. 19, 2010 in European Patent Application No. 06749155.5 filed Apr. 3, 2006 by Thomas H. James et al.
STMICROELECTRONICS; "Extension of the DiseqC 1 Standard for Control of Satellite Channel Router Based One-Cable LNBs"; Application Note; Oct. 5, 2004; pp. 1-12; XP002399973.

(56) References Cited

OTHER PUBLICATIONS

Notice of Allowance dated Sep. 16, 2010 in U.S. Appl. No. 11/097,625, filed Apr. 1, 2005 by Thomas H. James et al.
Chinese Office action dated Nov. 18, 2010 in Chinese Patent Application No. 200880017830.8 filed May 28, 2008 by John L Norin.
Translated Mexican Office action dated Oct. 12, 2010 in Mexican Patent Application No. MX/a/2008/015659 filed Jun. 18, 2007 by Hanno Basse et al.
Non-final Office action dated Jul. 7, 2011 in U.S. Appl. No. 11/810,774, filed Jun. 7, 2007 by Hanno Basse et al.
Chinese Office action dated May 23, 2011 in Chinese Patent Application No. 200780029062.3 filed Jun. 19, 2007 by Hanno Basse et al.
Notice of Allowance dated Dec. 23, 2010 in U.S. Appl. No. 11/219,418, filed Sep. 2, 2005 by Thomas H. James et al.
Notice of Allowance dated Jan. 20, 2011 in U.S. Appl. No. 10/255,344, filed Sep. 25, 2002 by Thomas H. James et al.
Final Rejection dated Jan. 18, 2011 in U.S. Appl. No. 11/097,482, filed Apr. 1, 2005 by Thomas H. James et al.
Final Rejection dated Jan. 12, 2011 in U.S. Appl. No. 11/810,774, filed Jun. 7, 2007 by Hanno Basse et al.
Final Rejection dated Jan. 31, 2011 in U.S. Appl. No. 11/820,205, filed Jun. 18, 2007 by Hanno Basse et al.
Non-final Office action dated Mar. 15, 2011 in U.S. Appl. No. 11/820,446, filed Jun. 19, 2007 by Thomas H. James et al.
Final Rejection dated May 14, 2012 in U.S. Appl. No. 11/820,446, filed Jun. 19, 2007 by Thomas H. James et al.
EPO communication dated May 3, 2012 in European Patent Application No. 06749157.1 filed Apr. 3, 2006 by Thomas H. James et al.
EPO Notice of intent to grant dated Apr. 26, 2012 in European Patent Application No. 06749158.9 filed Apr. 3, 2006 by Thomas H. James et al.
EPO Notice of intent to grant dated Apr. 26, 2012 in European Patent Application No. 06749162.1 filed Apr. 3, 2006 by Thomas H. James et al.
EPO communication dated Jun. 25, 2012 in European divisional Patent Application No. 09075217.1 filed Apr. 3, 2006 by Thomas H. James et al.
Non-final Office action dated Jun. 20, 2012 in U.S. Appl. No. 13/093,642, filed Apr. 25, 2011 by Thomas H. James et al.
Non-final Office action dated Jun. 19, 2012 in U.S. Appl. No. 11/219,247, filed Sep. 2, 2005 by Thomas H. James et al.
Final Rejection dated Jun. 11, 2012 in U.S. Appl. No. 11/219,407, filed Sep. 2, 2005 by Thomas H. James et al.
Non-final Office action dated Dec. 19, 2011 in U.S. Appl. No. 11/820,446, filed Jun. 19, 2007 by Thomas H. James et al.
European Telecommunications Satellite Organization (EUTELSAT); Digital Satellite Equipment Control (DiSEqC): Application Information for Tuner-Receivers/IRDs; Apr. 12, 1996; pp. 1-25.
Non-final Office action dated Feb. 22, 2012 in U.S. Appl. No. 11/219,407, filed Sep. 2, 2005 by Thomas H. James et al.
Final Rejection dated Jan. 18, 2012 in U.S. Appl. No. 11/810,774, filed Jun. 7, 2007 by Hanno Basse et al.
Final Rejection dated Oct. 9, 2012 in U.S. Appl. No. 13/093,642, filed Apr. 25, 2011 by Thomas H. James et al.
Final Rejection dated Feb. 8, 2013 in U.S. Appl. No. 11/820,446, filed Jun. 19, 2007 by Thomas H. James et al.
Non-final Office action dated Dec. 20, 2012 in U.S. Appl. No. 13/093,642, filed Apr. 25, 2011 by Thomas H. James et al.
Final Rejection dated Apr. 18, 2013 in U.S. Appl. No. 13/566,193, filed Aug. 3, 2012 by Robert F. Popoli.
Non-final Office action dated Sep. 14, 2012 in U.S. Appl. No. 13/566,193, filed Aug. 3, 2012 by Robert F. Popoli.
Non-final Office action dated Sep. 25, 2012 in U.S. Appl. No. 13/117,680, filed May 27, 2011 by Thomas H. James et al.
Final Rejection dated Sep. 18, 2012 in U.S. Appl. No. 11/810,774, filed Jun. 7, 2007 by Hanno Basse et al.
Notice of Allowance dated Mar. 14, 2013 in U.S. Appl. No. 11/097,724, filed Apr. 1, 2005 by Thomas H. James et al.
Non-final Office action dated Mar. 21, 2013 in U.S. Appl. No. 13/212,341, filed Aug. 18, 2011 by Thomas H. James et al.
Final Rejection dated Apr. 3, 2013 in U.S. Appl. No. 13/093,642, filed Apr. 25, 2011 by Thomas H. James et al.
Final Rejection dated Jul. 31, 2013 in U.S. Appl. No. 13/117,680, filed May 27, 2011 by Thomas H. James et al.
Non-final Office action dated Jul. 31, 2013 in U.S. Appl. No. 13/093,642, filed Apr. 25, 2011 by Thomas H. James et al.
Notice of Allowance dated Aug. 22, 2013 in U.S. Appl. No. 13/566,193, filed Aug. 3, 2012 by Robert F. Popoli.
Notice of Allowance dated Aug. 23, 2013 in U.S. Appl. No. 11/097,481, filed Apr. 1, 2005 by Thomas H. James et al.
Final Rejection dated Oct. 7, 2013 in U.S. Appl. No. 11/219,407, filed Sep. 2, 2005 by Thomas H. James et al.
Final Rejection dated Oct. 25, 2013 in U.S. Appl. No. 11/820,446, filed Jun. 19, 2007 by Thomas H. James et al.
Notice of Allowance dated Nov. 6, 2013 in U.S. Appl. No. 13/117,680, filed May 27, 2011 by Thomas H. James et al.
Notice of Allowance dated Oct. 30, 2013 in U.S. Appl. No. 13/212,341, filed Aug. 18, 2011 by Thomas H. James et al.
Non-final Office action dated Sep. 24, 2013 in U.S. Appl. No. 13/223,204, filed Aug. 31, 2011 by John Norin et al.
Non-final Office action dated Sep. 12, 2013 in U.S. Appl. No. 13/768,116, filed Feb. 15, 2013 by Hanno Basse et al.
Non-final Office action dated May 13, 2013 in U.S. Appl. No. 11/219,407, filed Sep. 2, 2005 by Thomas H. James et al.
EPO Communication dated Mar. 23, 2010 in European Patent Application No. 08767915.5 filed May 28, 2008 by John L. Norin.

* cited by examiner

INTEGRATED MULTI-SAT LNB AND FREQUENCY TRANSLATION MODULE

CROSS-REFERENCE TO RELATED APPLICATIONS

This application claims the benefit under 35 U.S.C. Section 119(e) of U.S. Provisional Application Ser. No. 60/932,060, filed on May 29, 2007, by John Norin, entitled "INTEGRATED MULTI-SAT LNB AND DIGITAL FREQUENCY TRANSLATION MODULE," and also claims the benefit under 35 U.S.C. Section 119(e) of U.S. Provisional Application Ser. No. 60/932,061, filed on May 29, 2007, by John Norin, entitled "DIGITAL FREQUENCY TRANSLATION MODULE WITHOUT DEMODULATION USING A/D and D/A FUNCTIONS," which applications are incorporated by reference herein.

BACKGROUND OF THE INVENTION

1. Field of the Invention

The present invention relates generally to a satellite receiver system, and in particular, to an integrated multiple-satellite receiver and frequency translation module assembly for such a satellite receiver system.

2. Description of the Related Art

Satellite broadcasting of communications signals has become commonplace. Satellite distribution of commercial signals for use in television programming currently utilizes multiple feedhorns on a single Outdoor Unit (ODU) which supply signals to up to eight Integrated Receiver/Decoders (IRDs) on separate cables from a multiswitch.

FIG. 1 illustrates a typical satellite television installation of the related art.

System 100 uses signals sent from Satellite A (SatA) 102, Satellite B (SatB) 104, and Satellite C (SatC) 106 that are directly broadcast to an Outdoor Unit (ODU) 108 that is typically attached to the outside of a house 110. ODU 108 receives these signals and sends the received signals to IRD 112, which decodes the signals and separates the signals into viewer channels, which are then passed to television 114 for viewing by a user. There can be more than one satellite transmitting from each orbital location.

Satellite uplink signals 116 are transmitted by one or more uplink facilities 118 to the satellites 102-104 that are typically in geosynchronous orbit. Satellites 102-106 amplify and rebroadcast the uplink signals 116, through transponders located on the satellite, as downlink signals 120. Depending on the satellite 102-106 antenna pattern, the downlink signals 120 are directed towards geographic areas for reception by the ODU 108.

Each satellite 102-106 broadcasts downlink signals 120 in typically thirty-two (32) different frequencies, either via satellites 102-106 or via terrestrial cable or wireless connection 122, which are licensed to various users for broadcasting of programming, which can be audio, video, or data signals, or any combination. These signals are typically located in the Ku-band of frequencies, i.e., 11-18 GHz. Future satellites will likely broadcast in the Ka-band of frequencies, i.e., 18-40 GHz, but typically 20-30 GHz.

FIG. 2 illustrates a typical ODU of the related art.

ODU 108 typically uses reflector dish 122 and feedhorn assembly 124 to receive and direct downlink signals 120 onto feedhorn assembly 124. Reflector dish 122 and feedhorn assembly 124 are typically mounted on bracket 126 and attached to a structure for stable mounting. Feedhorn assembly 124 typically comprises one or more Low Noise Block converters 128, which are connected via wires or coaxial cables to a multiswitch, which can be located within feedhorn assembly 124, elsewhere on the ODU 108, or within house 110. LNBs typically downconvert the FSS-band, Ku-band, and Ka-band downlink signals 120 into frequencies that are easily transmitted by wire or cable, which are typically in the L-band of frequencies, which typically ranges from 950 MHz to 2150 MHz. This downconversion makes it possible to distribute the signals within a home using standard coaxial cables.

The multiswitch enables system 100 to selectively switch the signals from SatA 102, SatB 104, and SatC 106, and deliver these signals via cables 124 to each of the IRDs 112A-D located within house 110. Typically, the multiswitch is a five-input, four-output (5×4) multiswitch, where two inputs to the multiswitch are from SatA 102, one input to the multiswitch is from SatB 104, and one input to the multiswitch is a combined input from SatB 104 and SatC 106. There can be other inputs for other purposes, e.g., off-air or other antenna inputs, without departing from the scope of the present invention. The multiswitch can be other sizes, such as a 6×8 multiswitch, if desired. SatB 104 typically delivers local programming to specified geographic areas, but can also deliver other programming as desired.

To maximize the available bandwidth in the Ku-band of downlink signals 120, each broadcast frequency is further divided into polarizations. Each LNB 128 can only receive one polarization at time, so by aligning polarizations between the downlink polarization and the LNB 128 polarization, downlink signals 120 can be selectively filtered out from travelling through the system 100 to each IRD 112A-D.

IRDs 112A-D currently use a one-way communications system to control the multiswitch. Each IRD 112A-D has a dedicated cable 124 connected directly to the multiswitch, and each IRD independently places a voltage and signal combination on the dedicated cable to program the multiswitch. For example, IRD 112A may wish to view a signal that is provided by SatA 102. To receive that signal, IRD 12A sends a voltage/tone signal on the dedicated cable back to the multiswitch, and the multiswitch delivers the sata 102 signal to IRD 112A on dedicated cable 124. IRD 112B independently controls the output port that IRD 112B is coupled to, and thus may deliver a different voltage/tone signal to the multiswitch. The voltage/tone signal typically comprises a 13 Volts DC (VDC) or 18 VDC signal, with or without a 22 kHz tone superimposed on the DC signal. 13 VDC without the 22 kHz tone would select one port, 13 VDC with the 22 kHz tone would select another port of the multiswitch, etc. There can also be a modulated tone, typically a 22 kHz tone, where the modulation schema can select one of any number of inputs based on the modulation scheme.

To reduce the cost of the ODU 108, outputs of the LNBs 128 present in the ODU 108 can be combined, or "stacked," depending on the ODU 108 design. The stacking of the LNB 128 outputs occurs after the LNB has received and downconverted the input signal. This allows for multiple polarizations, one from each satellite 102-106, to pass through each LNB 128. So one LNB 128 can, for example, receive the Left Hand Circular Polarization (LHCP) signals from SatC 102 and SatB 104, while another LNB receives the Right Hand Circular Polarization (RHCP) signals from SatB 104, which allows for fewer wires or cables between the LNBs 128 and the multiswitch.

The Ka-band of downlink signals 120 will be further divided into two bands, an upper band of frequencies called the "A" band and a lower band of frequencies called the "B" band. Once satellites are deployed within system 100 to broadcast these frequencies, each LNB 128 can deliver the signals from the Ku-band, the A band Ka-band, and the B band Ka-band signals for a given polarization to the multiswitch. However, current IRD 112 and system 100 designs cannot tune across this entire frequency band, which limits the usefulness of this stacking feature.

By stacking the LNB 128 inputs as described above, each LNB 128 typically delivers 48 transponders of information to the multiswitch, but some LNBs 128 can deliver more or less in blocks of various size. The multiswitch allows each output of the multiswitch to receive every LNB 128 signal (which is an input to the multiswitch) without filtering or modifying that information, which allows for each IRD 112 to receive more data. However, as mentioned above, current IRDs 112 cannot use the information in some of the proposed frequencies used for downlink signals 120, thus rendering useless the information transmitted in those downlink signals 120.

It can be seen, then, that there is a need in the art for a satellite broadcast system that can be expanded to include new satellites and new transmission frequencies.

SUMMARY OF THE INVENTION

To minimize the limitations in the prior art, and to minimize other limitations that will become apparent upon reading and understanding the present specification, the present invention discloses systems and devices for receiving signals.

A system in accordance with the present invention comprises a plurality of amplifiers, each amplifier in the plurality of amplifiers receiving the signals, a Frequency Translation Module, comprising a plurality of analog-to-digital converters, wherein each amplifier in the plurality of amplifiers is coupled to a separate analog-to-digital converter in the plurality of analog-to-digital converters, wherein the plurality of analog-to-digital converters convert the signals into digital data streams, a digital signal processing section, coupled to the plurality of analog-to-digital converters, wherein the digital signal processing section at least translates the frequency of the digital data streams and filters the digital data streams, a digital-to-analog section, coupled to the digital signal processing section; wherein the digital-to-analog section downconverts the satellite signals to an intermediate frequency band, and a receiver, coupled to the digital-to-analog section, wherein the receiver receives an output of the digital-to-analog section of the module at the intermediate frequency band, the output of the digital to analog section being on a single coaxial cable.

Such a system further optionally comprises a communications section, coupled between the digital-to-analog section and the receiver, wherein the intermediate frequency band including a band of frequencies from 250 Megahertz to 2150 Megahertz, the plurality of amplifiers being integrated with the Frequency Translation Module, an antenna reflector, coupled to the plurality of amplifiers, wherein the signals are transmitted from at least one satellite, the digital-to-analog section comprising only one digital-to-analog converter, and a multiswitch, coupled to the at least one antenna, wherein the multiswitch has a output separate from the output of the digital-to-analog section.

Another system in accordance with the present invention comprises at least one antenna, a module, coupled to the at least one antenna, the module comprising a plurality of translators for translating the satellite signals to an intermediate frequency band of signals, a plurality of filters, coupled to the plurality of translators, for filtering the intermediate band of signals, and a combiner, coupled to the plurality of filters, for combining the filtered intermediate band of signals into a composite signal, and a receiver, coupled to the combiner of the module, wherein the receiver receives the output of the combiner of the module at the intermediate frequency band.

Such a system further optionally comprises a multiswitch, coupled to the at least one antenna, wherein the multiswitch has a separate output from the combiner, and the intermediate frequency band including a band of frequencies from 250 Megahertz to 2150 Megahertz.

An integrated antenna in accordance with the present invention comprises an antenna, a plurality of converters, coupled to and receiving signals received by the antenna, for converting the signals into a plurality of data streams, a processing section, coupled to the plurality of converters, wherein the processing section at least filters the plurality of data streams, and a combining section, coupled to the processing section, for combining the plurality of data streams into a combined data stream, the combined data stream being output on a single output.

Such an antenna further optionally comprises the plurality of converters comprising a plurality of analog-to-digital converters, the processing section further translates the frequency of the data streams, and the combining section further comprising a digital-to-analog section, wherein the digital-to-analog section downconverts the signals to an intermediate frequency band. Such an antenna also optionally comprises the plurality of converters comprising a plurality of translators for translating the signals to an intermediate frequency band of signals, and the signals being transmitted to the antenna from a plurality of satellites.

Other features and advantages are inherent in the system and method claimed and disclosed or will become apparent to those skilled in the art from the following detailed description and its accompanying drawings.

BRIEF DESCRIPTION OF THE DRAWINGS

Referring now to the drawings in which like reference numbers represent corresponding parts throughout.

DETAILED DESCRIPTION OF THE PREFERRED EMBODIMENTS

Figure 1:
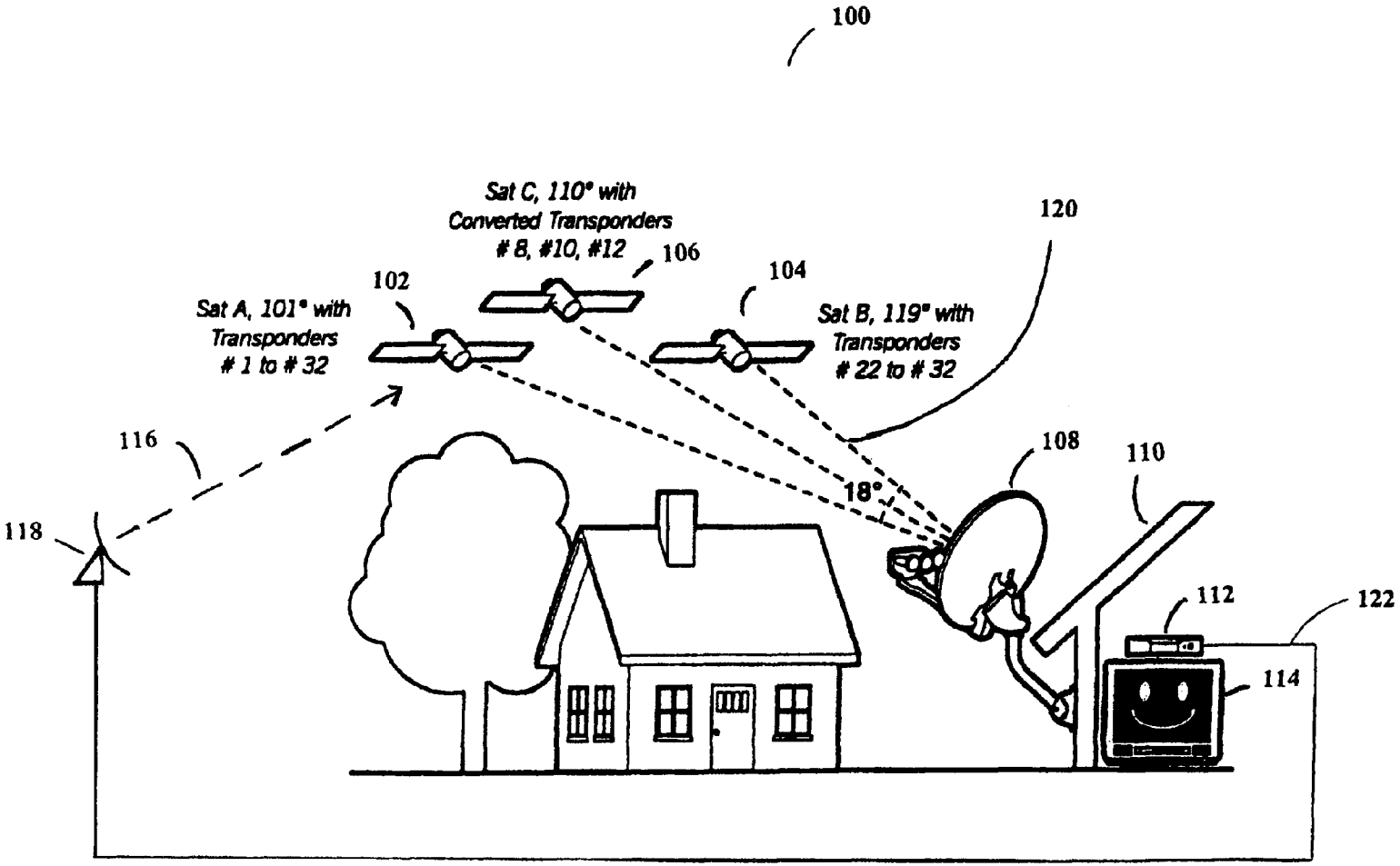
FIG. 1 illustrates a typical satellite television installation of the related art.
Figure 2:
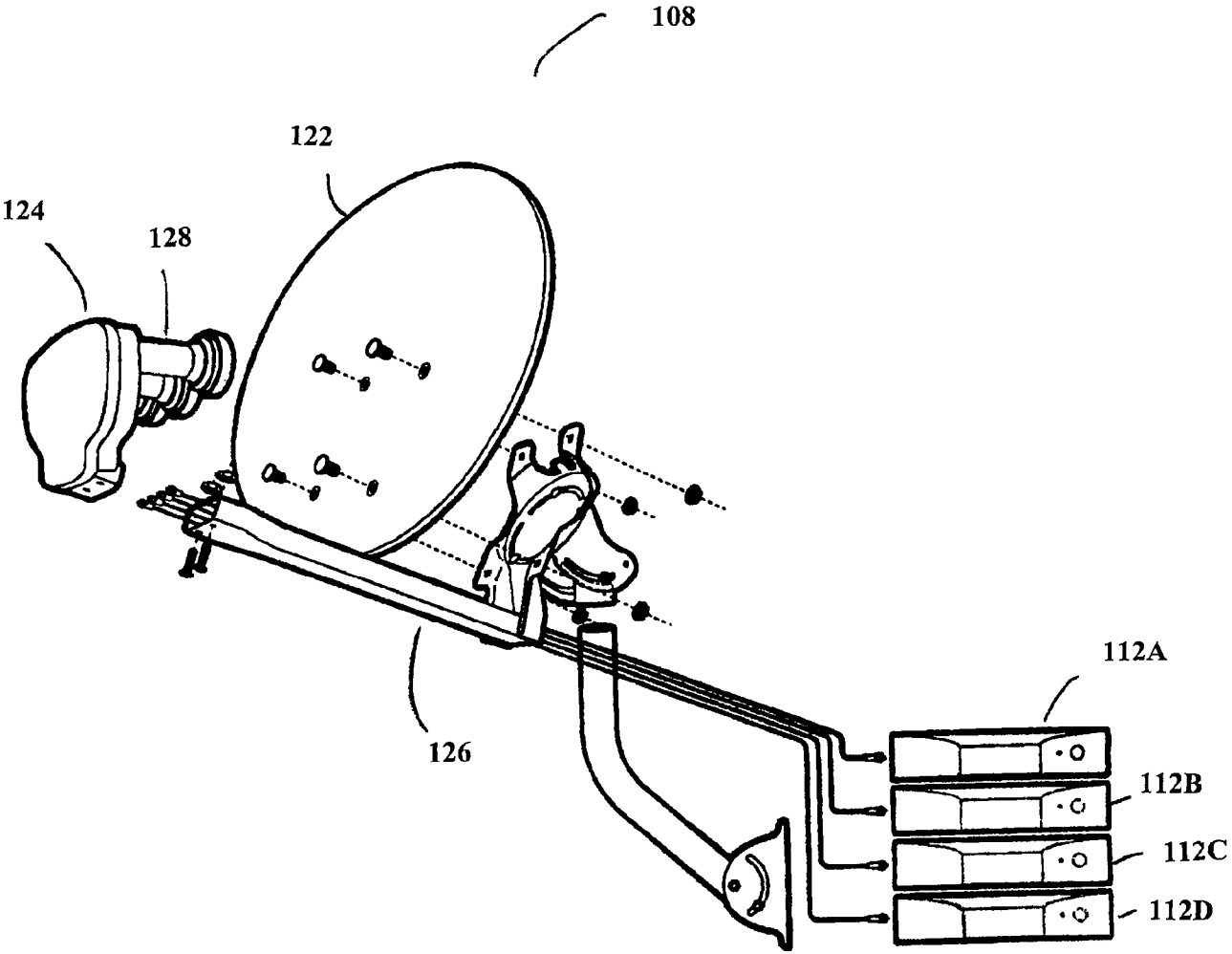
FIG. 2 illustrates a typical ODU of the related art.

In the following description, reference is made to the accompanying drawings which form a part hereof, and which show, by way of illustration, several embodiments of the present invention. It is understood that other embodiments may be utilized and structural changes may be made without departing from the scope of the present invention.

Overview

Currently, there are three orbital slots, each comprising one or more satellites, delivering direct-broadcast television programming signals. However, ground systems that currently receive these signals cannot accommodate additional satellite signals, and cannot process the additional signals that will be used to transmit high-definition television (HDTV) signals.

The HDTV signals can be broadcast from the existing satellite constellation, or broadcast from the additional satellite(s) that will be placed in geosynchronous orbit. The orbital locations of the satellites are fixed by regulation as being separated by nine degrees, so, for example, there is a satellite at 101 degrees West Longitude (WL), SatA 102; another satellite at 110 degrees WL, SatC 106; and another satellite at 119 degrees WL, SatB 104. Other satellites may be at other orbital slots, e.g., 72.5 degrees, 95, degrees, 99 degrees, and 103 degrees, and other orbital slots, without departing from the scope of the present invention. The satellites are typically referred to by their orbital location, e.g., SatA 102, the satellite at 101 WL, is typically referred to as "101." Additional orbital slots, with one or more satellites per slot, are presently contemplated at 99 and 103 (99.2 degrees West Longitude and 102.8 degrees West Longitude, respectively).

The present invention allows currently installed systems to continue receiving currently broadcast satellite signals, as well as allowing for expansion of additional signal reception and usage.

Multiswitch Port Selection

As described above, typically, the ports of a multiswitch are selected by the IRD 112 sending a DC voltage signal with or without a tone superimposed on the DC voltage signal to select a satellite 102-106. For example, and not by way of limitation, FOX News Channel may be located on transponder 22 from SatB 104. SatB 104 is typically selected by IRD 112 by sending an 18V signal with a 22 kHz tone superimposed on the 18V signal to the multiswitch, which then selects the downlink signal 120 coming from SatB 104. Additional processing is then done on signal 120 within IRD 112 to find the individual channel information associated with FOX News Channel, which is then displayed on monitor 114.

However, when new satellites 102-106 are operational, and additional signals as well as additional frequency bands become available, the currently distributed IRDs 112 must still operate, and new IRDs 112 capable of receiving, demodulating, and forwarding these new downlink signals 120 must also be able to perform these operations on existing and new signals.

The Ka-band of downlink signals 120 is divided into two Intermediate Frequency (IF) bands, an upper band of frequencies called the "A" band and a lower band of frequencies called the "B" band. Once satellites are deployed within system 100 to broadcast these frequencies, each LNB 128 can deliver the signals from the Ku-band, the A band Ka-band, and the B band Ka-band signals for a given polarization to the multiswitch.

By stacking the LNB 128 inputs as described above, each LNB 128 typically delivers 48 transponders of information to the multiswitch, but some LNBs 128 can deliver more or less in blocks of various size. The multiswitch allows each output of the multiswitch to receive every LNB 128 signal (which is an input to the multiswitch) without filtering or modifying that information, which allows for each IRD 112 to receive more data.

New IRDs 112 can use the information in some of the proposed frequencies used for downlink signals 120, and thus the information transmitted in those downlink signals 120 will be available to viewers as separate viewer channels.

Rather than assign new satellite selection codes to the new satellites 102-106, which can be done by using different DC voltages and/or different tones, either alone or in combination, the present invention stacks the signals to allow both legacy (older) IRDs 112 and new IRDs 112 to receive the current downlink signals 120 using the already-known selection criteria (13/18 VDC, with or without 22 kHz tones), and for the new IRDs 112 that can receive and demodulate the new satellite downlink signals 120, those same codes will access the new satellite downlink signals 120, because those signals will be intelligently stacked on top of the current downlink signals 120.

This approach still suffers, however, from limitations on the sizes of the A and B bands. Once the A and B bands are full with content from satellites 102-106, there again remains no room for expansion of system 100.

ODU Design and Stacking Plan

Figure 3:
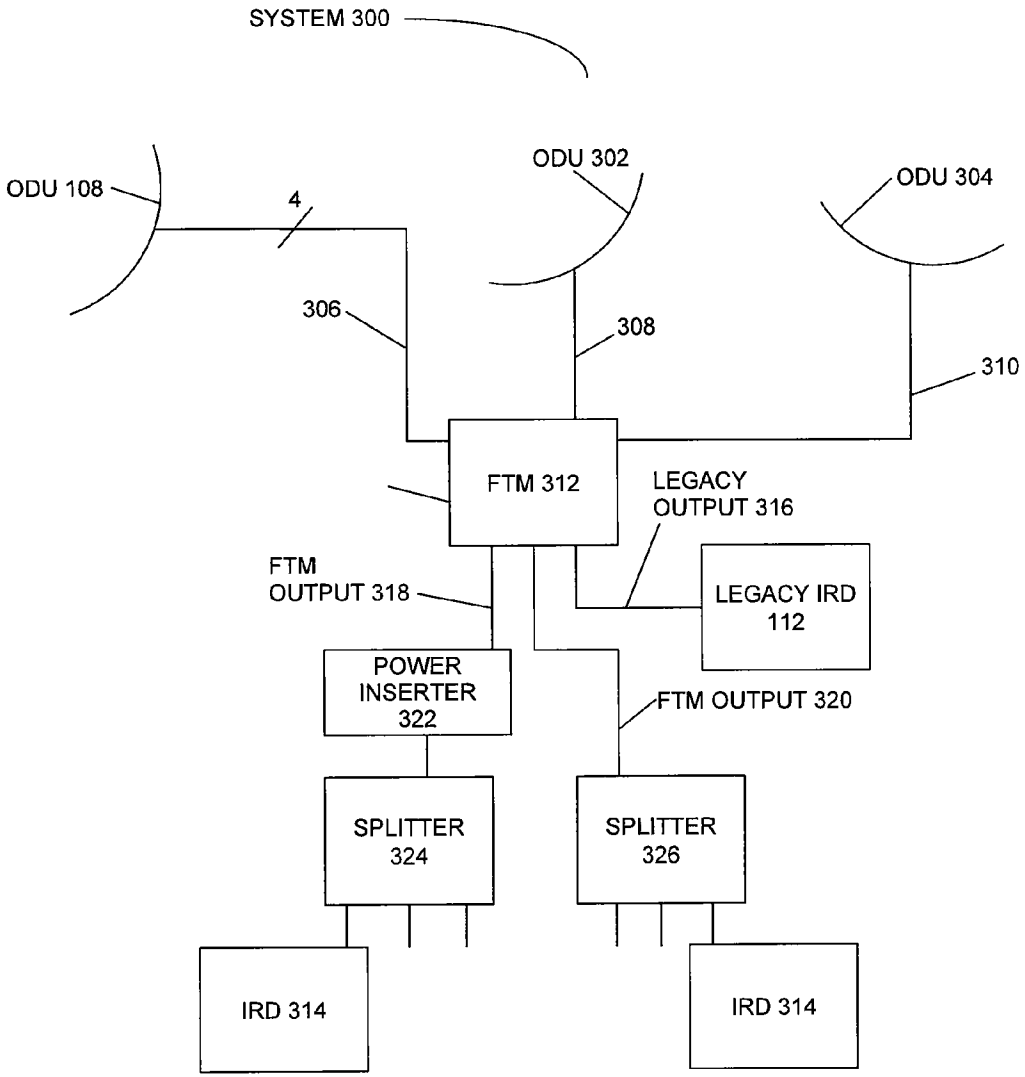
FIG. 3 illustrates a typical installation of a satellite receive system of the related art.

FIG. 3 illustrates a typical installation of a satellite receive system of the related art.

System 300 typically comprises ODU 108, and two additional ODUs 302 and 304. ODU 302 typically receives signals in the Ku-band from satellites located at 95 degrees West Longitude, and ODU 304 typically receives signals in the Ku-band from satellites located at 72.5 degrees West Longitude. Other satellite orbital slots and ODU configurations are possible.

ODUs 108, 302, and 312 send signals over cables 306, 308, and 310 respectively to Frequency Translation Module (FTM) 312. FTM 312 downconverts and translates these signals to frequency bands that are acceptable to IRDs 112 and 314, typically in the frequency bands of 950-1450 MHz, and 1650-2150 MHz. For legacy IRDs 112, these are typically connected to FTM 312 via legacy output 316, because legacy IRDs typically only accept signals in the 950-1450 MHz band. Legacy IRDs 112 are typically IRDs 112 that do not have the capability of communicating with the FTM outside of a stacked frequency plan, or outside of the related art 250-2150 MHz schema.

There are FTM outputs 318 and 320 of FTM 312, which are the downconverted and demodulated signals received from ODUs 108, 302, and 304, and these are either sent to power inserter 322, which then has that signal split by splitter 324 for delivery to IRD 314, or is sent directly to a splitter 326 for delivery to an IRD 314.

The limitations of this approach is that the components required for delivery of the signals to the IRDs 314, e.g., splitters 324 and 326, power inserter 322, and the internal components of FTM 312, are very costly. Further, the system is complex in that power for the components, e.g., splitters 324 and 326, power inserter 322, etc. are not powered by the IRD 314, and, as such, require additional power sources. Further, the numerous cable connections make installation difficult. Further, system 300 draws an unknown amount of power, and the power range of such as system 300 is very broad, because of the number of LNBs associated with three different ODUs 108, 302, and 304, as well as the intricacies of FTM 312 to be able to deliver such power to the LNBs at the various ODUs 108, 302, and 304.

This approach also suffers from limitations on the sizes of the A and B bands. Once the A and B bands are full with content from satellites 102-106, there again remains no room for expansion of system 100. Other problems with the related art architectures that are improved with the present invention are: cost, power consumption, heat dissipation, package weight, local oscillator isolation in both the FTM and LNB, transient effects on signal quality, signal dynamic range and ALC complexity, and installation complexity due to the reduced number of cables to be connected to the device.

Integrated LNB/FTM System

Figure 4:
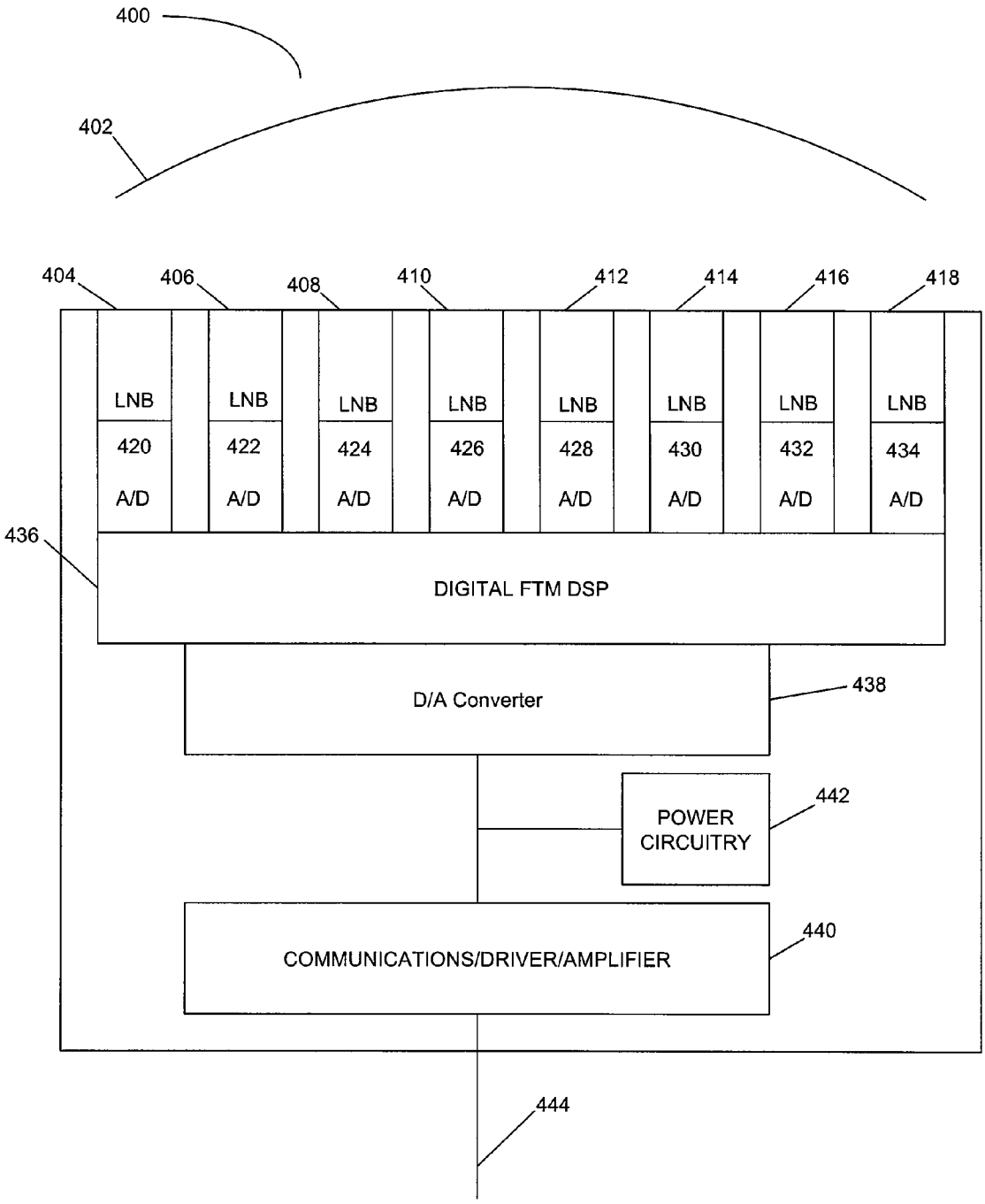
FIG. 4 illustrates an embodiment of the present invention.

The integrated LNB+FTM in a digital implementation without demodulation is shown in FIG. 4.

FIG. 4 illustrates system 400, with reflector 402 reflecting received signals 120 to various LNBs 404-416. As shown in FIG. 4, an expected configuration supports five satellite orbital locations, with LNBs 404 and 406 receiving signals from 99 in the Ka-band, LNBs 408 and 410 receiving signals from 103 in the Ka-band, LNBs 412 and 414 receiving signals from 101 in the Ku band, and LNBs 416 and 418 receiving signals from 110 and 119 in the Ku-band, on a single reflector 402.

Selection of the LO and downconverted IF frequencies in system 400 may or may not replicate those in the related art, as the digital or analog FTM functions of the present invention can translate the LNB outputs from a wide range of frequencies. This aspect of the present invention allows for RF optimization of harmonics, spurious and leakage/interference signals that are present in the related art LNB designs in current use.

Each LNB 404-418 is coupled to a dedicated Analog-to-Digital (A/D) converter 420-434, each of which provides an output to the Digital FTM Digital Signal Processor (DSP) 436. The DSP 436 then provides a digital data stream to a high-speed Digital-to-Analog (D/A) converter 438, which forward a converted analog signal to the communications circuits 440.

The signals from the LNBs 404-418, after downconversion to a lower IF frequency, enter the high speed A/Ds 420-434 in a digital implementation as shown, or, if an analog system is preferred, would enter a switching matrix in an analog implementation of system 400. As the signals enter the A/Ds 420-434, the signal levels will be in a tighter (narrower) power level range than that in the related art FTM approach. Thus, there is potential to reduce the gain and power consumption of the LNB stages 404-418 when tightly coupled with the A/D 420-434 stage. The signal filtering and frequency translation take place as appropriate in the DSP 436, followed by an output D/A 438, which can also include a driver stage if desired, to set the final signal levels for transmission on the coax.

Power circuitry 442 is also provided to power the LNBs 404-418, A/Ds 420-434, DSP 436, D/A 438, and Communications circuits 440. Communications circuits 440 can also comprise drivers and amplifiers as necessary to provide proper signal strength to signal 444 for use at IRD 112 and/or 314. Power circuitry 442 and communications circuits 440 also provide housekeeping functions to the existing FTM/ODU as needed, including FTM communications circuitry, possible tone/DiSEqC circuitry, and other legacy functions.

This invention implements the functionality of the FTM together with the LNB electronics in a multi-sat outdoor unit. This is done in either an all digital manner using analog-to-digital (A/D) converters, digital filtering, digital signal processing, and digital to analog converters, or, in the existing FTM format of analog frequency translation. The invention takes advantage of the high volume of ODUs 108 that will use 99/101/103/110/119 satellites while avoiding signals from 72.5 and 95, and, as such, an integrated product in accordance with the present invention reduces cost and simplifies installation and operation of system 400.

The benefit of integrating the ODU and FTM is that it reduces the complexity, cost, and power consumption of the architecture. This also reduces cabling complexity and installation time. Cross-satellite and cross-polarized interference will also be reduced. Standalone analog and digital FTM architectures will remain useful for more customized configurations that require multiple satellite dishes, however, standard installations with a single satellite dish, with customization for individualized installations where other services, such as additional satellite services, broadband wireless (WiMax, etc.), or other inputs to the system are possible without departing from the scope of the present invention. An integrated digital FTM and LNB simplifies the A/D 420-434 sampling problems by allowing lower frequency IF outputs of the LNBs 404-418, as well as allowing a highly flexible LNB 404-418 LO frequency to be used to minimize spurs.

Figure 5:
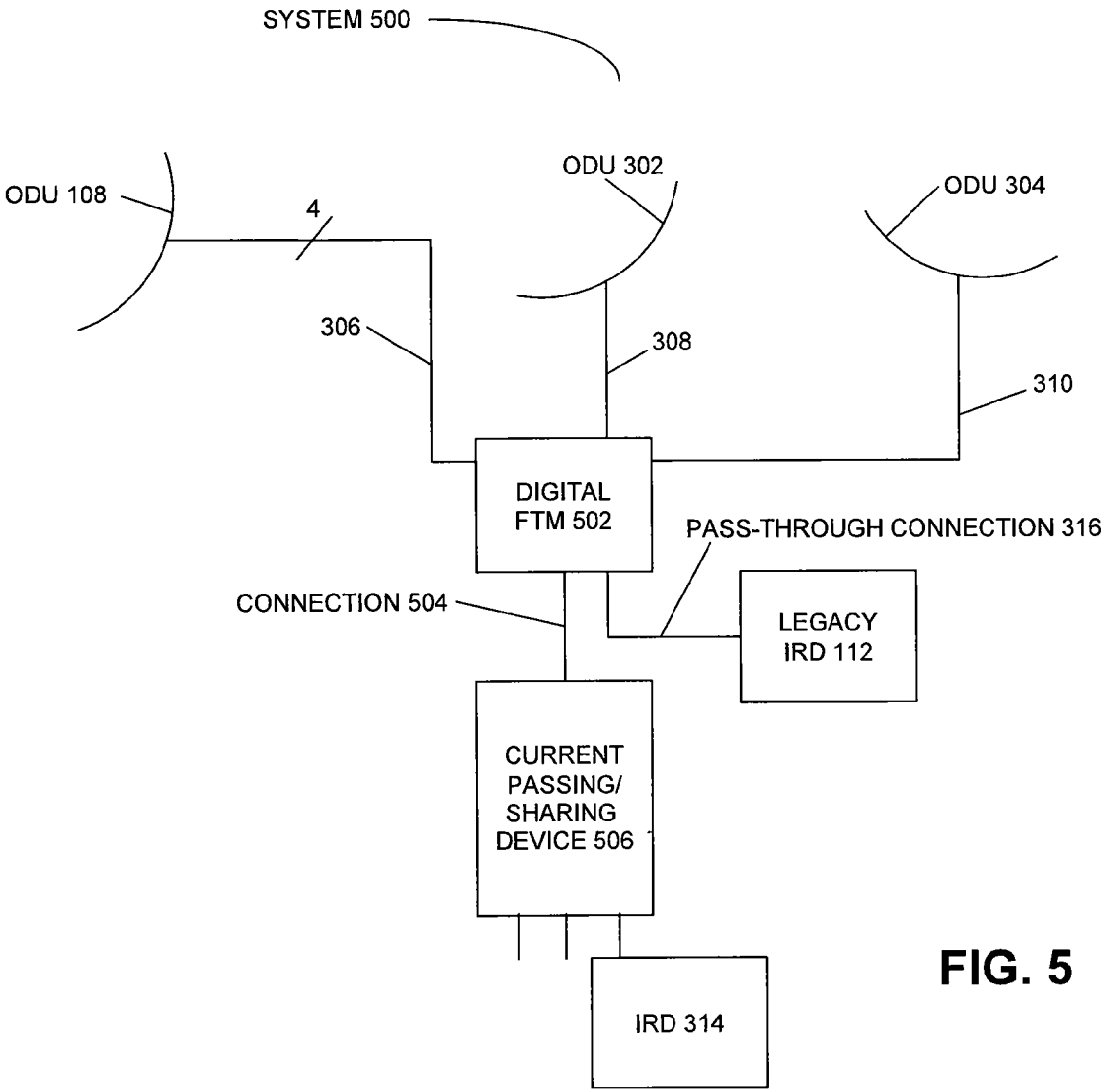
FIG. 5 illustrates an alternative embodiment of the present invention.

FIG. 5 illustrates an embodiment of the present invention.

System 500 comprises a similar ODU 108, 302, and 304 connection to the Digital FTM 502 of the present invention. Digital FTM 502 has a pass-through connection 316 to legacy IRDs 112, but has a single connection 504 to a current passing/sharing device 506 which connects directly to IRD 314.

Figure 6:
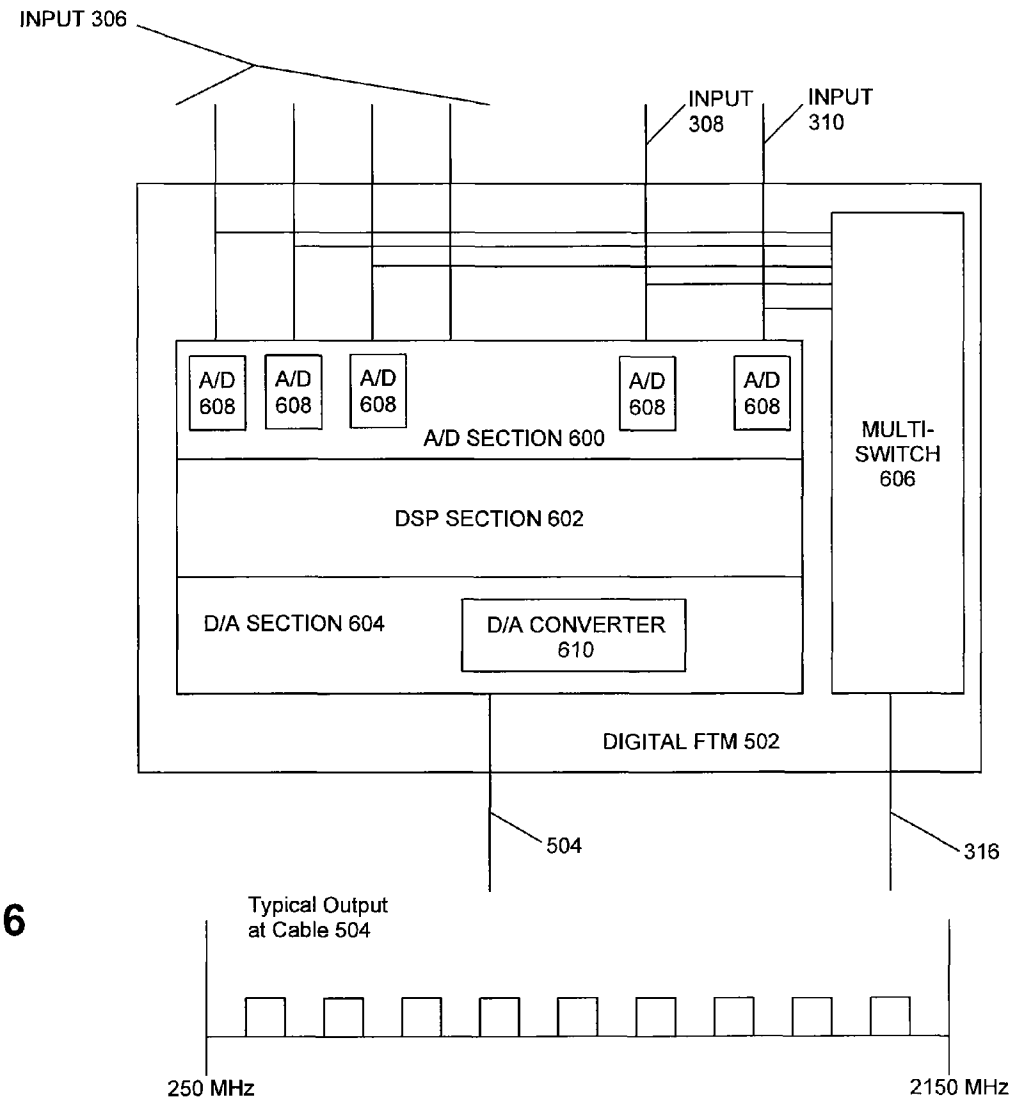
FIG. 6 illustrates additional details of the digital FTM described in FIG. 5.

FIG. 6 illustrates additional details of the digital FTM described in FIG. 5.

Digital FTM 502 comprises an analog-to-digital (A/D) section 600, a Digital Signal Processing (DSP) section 602, and digital-to-analog (D/A) section 604. Each of the inputs 306-310 is fed into the A/D section 600, and also fed into a multiswitch 606 for delivery to legacy IRDs 112 via cable 316.

Within A/D section 600, a number of individual A/D converters (ADC)s 608 are present. The ADC 608 are capable of digitizing LNB outputs, as well as lower frequency signals, and can be matched with DSP section 602 to properly digitize the analog signals received by the LNBs at the various ODUs 108, 302, and 304.

The outputs of the various ADCs 608 are processed by DSP section 602, and fed to a single D/A converter 610 within D/A section 604. The D/A converter 610 then outputs the processed signals on a single cable 504 which is used as an input signal to all IRDs 314. The output of D/A converter 510 is an analog signal that has not been demodulated. A typical output on cable 504 is shown.

Figure 7:
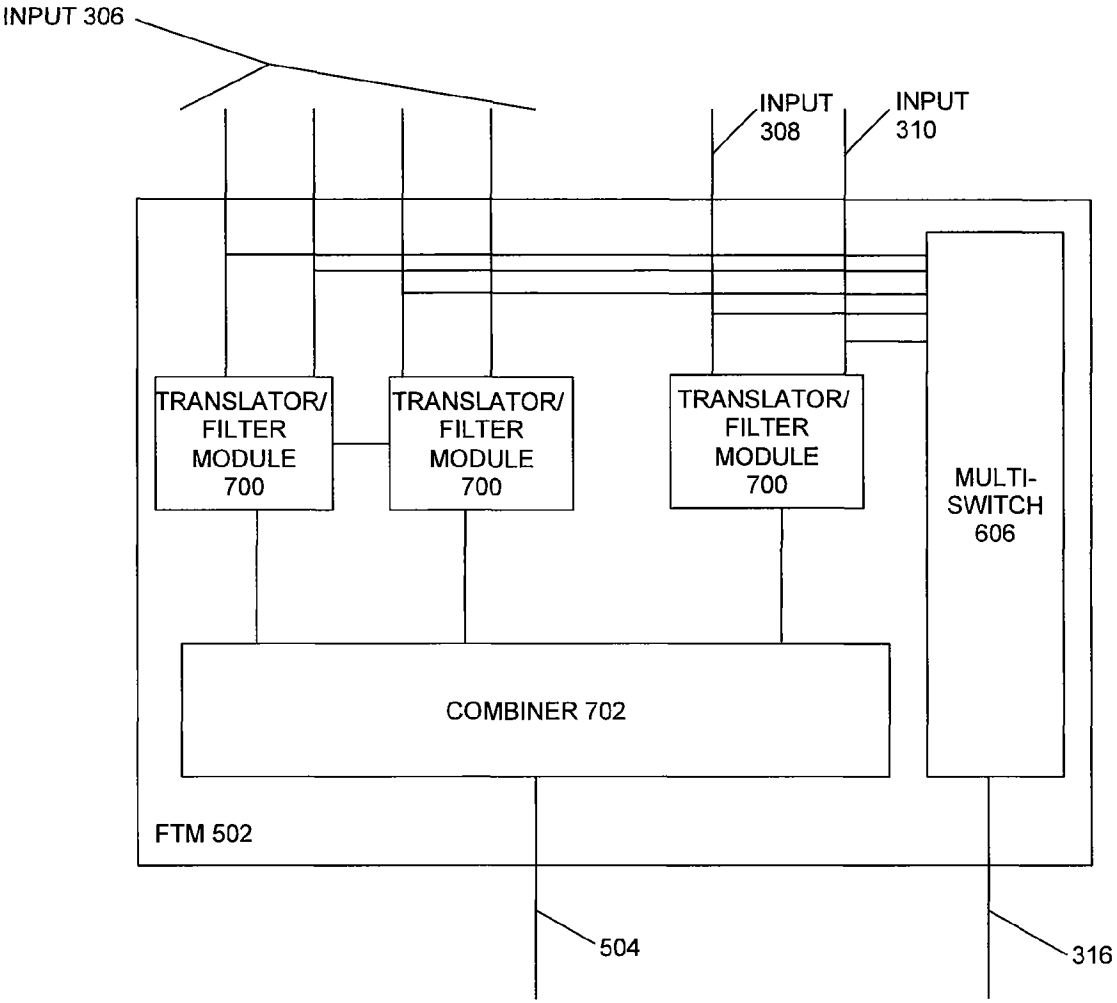
FIG. 7 illustrates an alternative embodiment of the present invention.

FIG. 7 illustrates an alternative embodiment of the present invention.

Instead of digitizing the analog signals and then converting them back to analog signals after processing, FTM 402 can use an analog superheterodyne frequency translation and filtering technique. Analog translator/filter modules (TFM) 700 translates the Ka and Ku-band signals into IF signals, which are then shared between the TFMs 700, and combined by combiner 702 into a single signal which is output from cable 504. As with other embodiments, the optional multiswitch 606 can still be implemented to allow legacy IRDs 112 to receive signals via cable 316.

The implementations shown in FIGS. 6 and 7 can be packaged with the LNB housing as an integrated unit, or can be placed elsewhere in the system 500 to allow for use with current ODU 108 products if desired.

Although described with respect to satellite-based signal delivery systems, the present invention can be used with terrestrial signal delivery systems, e.g., cable-based systems, without departing from the scope of the present invention. Further, although the outputs of the system are typically described on coaxial cables, other connections, e.g., network cables, wireless connections, etc., can be used without departing from the scope of the present invention.

Conclusion

In summary, the present invention comprises systems and devices for receiving signals.

A system in accordance with the present invention comprises a plurality of amplifiers, each amplifier in the plurality of amplifiers receiving the signals, a Frequency Translation Module, comprising a plurality of analog-to-digital converters, wherein each amplifier in the plurality of amplifiers is coupled to a separate analog-to-digital converter in the plurality of analog-to-digital converters, wherein the plurality of analog-to-digital converters convert the signals into digital data streams, a digital signal processing section, coupled to the plurality of analog-to-digital converters, wherein the digital signal processing section at least translates the frequency of the digital data streams and filters the digital data streams, a digital-to-analog section, coupled to the digital signal processing section; wherein the digital-to-analog section downconverts the satellite signals to an intermediate frequency band, and a receiver, coupled to the digital-to-analog section, wherein the receiver receives an output of the digital-to-analog section of the module at the intermediate frequency band, the output of the digital to analog section being on a single coaxial cable.

Such a system further optionally comprises a communications section, coupled between the digital-to-analog section and the receiver, wherein the intermediate frequency band including a band of frequencies from 250 Megahertz to 2150 Megahertz, the plurality of amplifiers being integrated with the Frequency Translation Module, an antenna reflector, coupled to the plurality of amplifiers, wherein the signals are transmitted from at least one satellite, the digital-to-analog section comprising only one digital-to-analog converter, and a multiswitch, coupled to the at least one antenna, wherein the multiswitch has a output separate from the output of the digital-to-analog section.

Another system in accordance with the present invention comprises at least one antenna, a module, coupled to the at least one antenna, the module comprising a plurality of translators for translating the satellite signals to an intermediate frequency band of signals, a plurality of filters, coupled to the plurality of translators, for filtering the intermediate band of signals, and a combiner, coupled to the plurality of filters, for combining the filtered intermediate band of signals into a composite signal, and a receiver, coupled to the combiner of the module, wherein the receiver receives the output of the combiner of the module at the intermediate frequency band.

Such a system further optionally comprises a multiswitch, coupled to the at least one antenna, wherein the multiswitch has a separate output from the combiner, and the intermediate frequency band including a band of frequencies from 250 Megahertz to 2150 Megahertz.

An integrated antenna in accordance with the present invention comprises an antenna, a plurality of converters, coupled to and receiving signals received by the antenna, for converting the signals into a plurality of data streams, a processing section, coupled to the plurality of converters, wherein the processing section at least filters the plurality of data streams, and a combining section, coupled to the processing section, for combining the plurality of data streams into a combined data stream, the combined data stream being output on a single output.

Such an antenna further optionally comprises the plurality of converters comprising a plurality of analog-to-digital converters, the processing section further translates the frequency of the data streams, and the combining section further comprising a digital-to-analog section, wherein the digital-to-analog section downconverts the signals to an intermediate frequency band. Such an antenna also optionally comprises the plurality of converters comprising a plurality of translators for translating the signals to an intermediate frequency band of signals, and the signals being transmitted to the antenna from a plurality of satellites.

It is intended that the scope of the invention be limited not by this detailed description, but rather by the claims appended hereto and the equivalents thereof. The above specification, examples and data provide a complete description of the manufacture and use of the composition of the invention. Since many embodiments of the invention can be made without departing from the spirit and scope of the invention, the invention resides in the claims hereinafter appended and the equivalents thereof.

What is claimed is:

1. A system for receiving signals, comprising:

a plurality of amplifiers, each amplifier in the plurality of amplifiers receiving the signals and outputting a modulated signal, the plurality of amplifiers being integrated with a frequency translation module;

wherein the frequency translation module, comprises:

a plurality of analog-to-digital converters, wherein each amplifier in the plurality of amplifiers is coupled to a dedicated analog-to-digital converter in the plurality of analog-to-digital converters, wherein the plurality of analog-to-digital converters convert the modulated signals into digital data streams;

a digital signal processing section, coupled to the plurality of analog-to-digital converters, wherein the digital signal processing section at least translates the frequency of the digital data streams and filters the digital data streams;

a digital-to-analog section, coupled to the digital signal processing section; and a receiver, coupled to the digital-to-analog section, wherein the receiver receives an output of the digital-to-analog section of the module at the intermediate frequency band, the output of the digital to analog section being on a single coaxial cable.

2. The system of claim 1, further comprising a communications section, coupled between the digital-to-analog section and the receiver, the communications section comprising circuitry to provide at least proper signal strength of the digital-to-analog section to the receiver.

3. The system of claim 1, wherein the intermediate frequency band includes a band of frequencies from 250 Megahertz to 2150 Megahertz.

4. The system of claim 1, further comprising an antenna reflector, coupled to the plurality of amplifiers, wherein the signals are transmitted from at least one satellite.

5. The system of claim 1, wherein the digital-to-analog section comprises only one digital-to-analog converter.

6. The system of claim 1, further comprising a multiswitch, coupled to the at least one antenna, wherein the multiswitch has a output separate from the output of the digital-to-analog section.

7. A system for receiving modulated satellite signals, comprising:

at least one antenna;

a module, coupled to the at least one antenna, the module comprising:

a plurality of translators for translating the modulated satellite signals to a modulated intermediate frequency band of signals;

a plurality of analog-to-digital converters, integrated with the plurality of translators, for digitizing the modulated satellite signals;

a digital signal processor, for filtering the digitized modulated intermediate band of signals and for combining the filtered digitized modulated intermediate band of signals into a composite signal; and a receiver, coupled to the module, wherein the receiver receives the composite signal in the intermediate frequency band.

8. The system of claim 7, wherein the modulated intermediate frequency band includes a band of frequencies from 250 Megahertz to 2150 Megahertz.

9. The system of claim 7, wherein the plurality of translators being integrated with the plurality of analog-to-digital converters thereby narrows the power level range of the modulated signals provided to the plurality of analog-to-digital converters.

10. An integrated antenna, comprising:

a plurality of translators, for translating the signals received by the antenna into an intermediate frequency band of signals;

a plurality of converters, integrated with and coupled to the plurality of translators, for digitizing the intermediate frequency band of signals into a plurality of modulated data streams;

a digital processing section, coupled to the plurality of converters, wherein the digital processing section at least filters the plurality of modulated data streams; and a combining section, coupled to the processing section, for combining the plurality of modulated data streams into a combined data stream, the combined data stream being output on a single output.

11. The integrated antenna of claim 10, wherein the digital processing section further translates the frequency of the modulated data streams.

12. The integrated antenna of claim 11, wherein the combining section further comprises a digital-to-analog section, wherein the digital-to-analog section downconverts the combined data stream.

13. The integrated antenna of claim 10, wherein the signals are transmitted to the antenna from a plurality of satellites.

14. The system of claim 1, wherein the plurality of amplifiers being integrated with the frequency translation module thereby narrows the power level range of the modulated signals provided to the plurality of analog-to-digital converters.

15. The integrated antenna of claim 10, wherein the plurality of translators being integrated with the plurality of converters thereby narrows the power level range of the modulated signals provided to the plurality of analog-to-digital converters.

* * * * *